US007805790B2

(12) United States Patent
DeMoss

(10) Patent No.: US 7,805,790 B2
(45) Date of Patent: Oct. 5, 2010

(54) FOAM SPRINGS AND INNERSPRING COMBINATIONS FOR MATTRESSES

(75) Inventor: Larry K. DeMoss, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 150 days.

(21) Appl. No.: 12/355,923

(22) Filed: Jan. 19, 2009

(65) Prior Publication Data

US 2009/0183314 A1 Jul. 23, 2009

Related U.S. Application Data

(60) Provisional application No. 61/022,041, filed on Jan. 18, 2008.

(51) Int. Cl.
*A47C 27/05* (2006.01)
*A47C 23/04* (2006.01)

(52) U.S. Cl. ..... 5/716; 5/717; 5/718

(58) Field of Classification Search ..... 5/716–721, 5/739, 655.9, 740, 953, 247, 255, 642, 654.1, 5/655.7; 267/96, 91
See application file for complete search history.

(56) References Cited

U.S. PATENT DOCUMENTS

| | | | | |
|---|---|---|---|---|
| 4,811,439 | A | 3/1989 | Siegel et al. | |
| 5,222,264 | A | 6/1993 | Morry | |
| 5,239,715 | A | 8/1993 | Wagner | |
| 5,467,488 | A | 11/1995 | Wagner | |
| 5,469,590 | A | 11/1995 | Simon | |
| 5,687,439 | A | 11/1997 | Wagner | |
| 5,704,085 | A | 1/1998 | Sabalaskey | |
| 5,724,686 | A * | 3/1998 | Neal | 5/717 |
| 5,756,022 | A | 5/1998 | Siegel et al. | |
| 5,787,532 | A * | 8/1998 | Langer et al. | 5/717 |
| 5,832,551 | A | 11/1998 | Wagner | |
| 6,223,370 | B1 | 5/2001 | Kluft | |
| 6,249,924 | B1 | 6/2001 | Kluft | |
| 6,263,533 | B1 * | 7/2001 | Dimitry et al. | 5/717 |
| 6,484,338 | B1 | 11/2002 | Hagglund | |
| 6,948,205 | B2 | 9/2005 | Van Der Wurf et al. | |

(Continued)

FOREIGN PATENT DOCUMENTS

EP 0819398 A3 2/2000

(Continued)

*Primary Examiner*—Robert G Santos
(74) *Attorney, Agent, or Firm*—James C. Scott; Roetzel & Andress

(57) ABSTRACT

A dual spring support structure for mattresses or other reflexive support structures employs a foam spring in combination with an innerspring or foam core, to provide a multi-mode and multi-structural support surface with a multiple, constant, or complimentary spring rate and support characteristics. Foam springs have geometric cross-sectional configurations with mechanical spring properties which work in concert with the spring properties of foam. Foam springs are used in one embodiment about the perimeter of a wire form innerspring or about the perimeter of a foam core. The foam springs may have a spring rate that is complimentary to, greater than or less than the spring rate of the innerspring or core. Foam springs of different configurations and spring rates can be combined with different types of cores, or used alone to provide a spring or cushioning structure.

19 Claims, 5 Drawing Sheets

U.S. PATENT DOCUMENTS

| | | | | |
|---|---|---|---|---|
| 7,082,635 | B2 * | 8/2006 | Barman et al. | 5/717 |
| 7,631,381 | B2 | 12/2009 | Flippin | |
| 7,636,971 | B2 * | 12/2009 | DeMoss | 5/716 |
| 7,640,611 | B1 | 1/2010 | Kluft | |
| 7,644,461 | B2 | 1/2010 | Zinus | |
| 2003/0019043 | A1 | 1/2003 | Bryant et al. | |
| 2004/0172766 | A1 | 9/2004 | Formenti | |
| 2004/0187217 | A1 * | 9/2004 | Barman et al. | 5/716 |
| 2006/0260062 | A1 * | 11/2006 | Barman et al. | 5/717 |
| 2008/0184492 | A1 | 8/2008 | Sunde | |
| 2009/0183314 | A1 * | 7/2009 | Demoss | 5/716 |
| 2009/0183315 | A1 * | 7/2009 | DeMoss | 5/718 |

FOREIGN PATENT DOCUMENTS

| | | |
|---|---|---|
| EP | 0742751 | 5/2003 |
| EP | 0819398 B1 | 9/2003 |
| WO | WO9521048 | 8/1995 |

* cited by examiner

FOAM SPRINGS AND INNERSPRING COMBINATIONS FOR MATTRESSES

RELATED APPLICATIONS

This application claims priority to U.S. Provisional Patent Application No. 61/022,041, filed Jan. 18, 2008.

FIELD OF THE INVENTION

This disclosure and related inventions pertain to mattresses and, more specifically, to mattresses with multi-mode and multi-structural support surfaces with multiple, constant, or complimentary spring rates and support characteristics.

BACKGROUND OF THE INVENTION

Metal springs, foam layers, solid foam blocks, water, air, and other structures have been employed in mattress constructions. These materials may be used separately or in combination. Mattresses are constructed with various levels of firmness to provide different degrees and types of support. The edge region of a mattress, i.e., the horizontal support area proximate to the vertical side walls, is a critical area of construction in order to prevent roll-off or the tendency for the support surface to taper downward toward the edge, and to withstand seating pressure. If overbuilt, the transition between the mattress edge and the innerspring can be abrupt and uncomfortable. The mattress edge typically does not provide much support to one in such a seated position. Also, with regard to the sleeping area, having a stronger and more supportive mattress edge expands the sleeping area so that the consumer may sleep on or close to the edge without the uncomfortable and uneven transition between the innerspring and mattress edge.

The present disclosure will provide a mattress having an edge that creates a seamless transition to the innerspring and that provides a stronger, more supportive seating edge which will contribute to the overall comfort and support of the entire mattress.

SUMMARY OF THE INVENTION

Foam springs and innerspring combinations are disclosed which include foam spring components which are employed at an edge region of a mattress, proximate to edges of a mattress innerspring or core. One aspect of the present disclosure and related inventions is a foam spring which functions as an internal component of a mattress as both a spring member and a support member. The foam spring includes one or more first segments which extend in a first direction and which are interconnected with one or more second segments which extend in a second direction, the foam spring having both a mechanical spring action and a foam cushion support characteristic as a result of the interconnection and relative movement of the first and second segments, and a foam spring action resulting from compressibility and resilience material properties of the foam from which the foam spring is made.

Another aspect of the disclosure and related inventions is the combination of foam springs 10 of the type described and variants thereof, including extruded foam springs structures, with wire or steel springs or coils, such as for example, wire form coils which are combined together to form an innerspring such as are used in mattresses and other flexible support structures. As known in the wire forming and mattress industries, a typical wire form innerspring consists of a plurality of individual wire form coils, such as helical coils, which are interconnected in a rectangular matrix or array to provide the reflexive spring core for a mattress. Padding and upholstery is secured over the innerspring to complete the mattress, with one or both major planar sides defined by the ends of the coils of the innerspring used as a support or sleep surface.

A further aspect of the present disclosure and related inventions is the combination of a foam spring with an innerspring, wherein one or more pieces of the foam spring are positioned proximate to or about a perimeter of an innerspring, such as a wire form innerspring with a plurality of springs or coils, whereby a surface of the foam spring is contiguous with a support surface or plane of the innerspring and is compressible in conjunction with the innerspring, and wherein a spring rate of the foam spring is comparable with or complimentary to a spring rate of the innerspring, or is intentionally made different that a spring rate of the innerspring.

Another aspect of the present disclosure and related inventions includes a mattress with multi-mode and multi-structural support surface with a multiple, constant, or complimentary spring rate and support characteristics as a function of the innerspring and surrounding foam constructs acting separately and in concert.

These and other aspects of the disclosure and related inventions are further disclosed and claimed herein, with reference to the accompanying drawings of particular, preferred and alternate embodiments of the various inventive concepts.

DETAILED DESCRIPTION OF PREFERRED AND ALTERNATE EMBODIMENTS

This disclosure and related inventions pertain to foam structures or constructs which have a spring configuration, referred to herein as "foam spring", and foam springs in combination with wire form springs for use in an innerspring system for a mattress, seating, furniture or other reflexive support structure. When employed as the innerspring of a mattress, the foam springs and wire form innerspring have a combined mechanical spring action and a foam spring action. The foam springs are preferably used in combination with an innerspring, wherein one or more pieces of the foam spring are positioned proximate to or about a perimeter of an innerspring, and whereby a surface of the foam spring is contiguous with a support surface or plane of the innerspring and is compressible in conjunction with the innerspring, and wherein a spring rate of the foam spring is comparable with or complimentary to a spring rate of the innerspring, or is intentionally made different than a spring rate of the innerspring.

Figure 1:
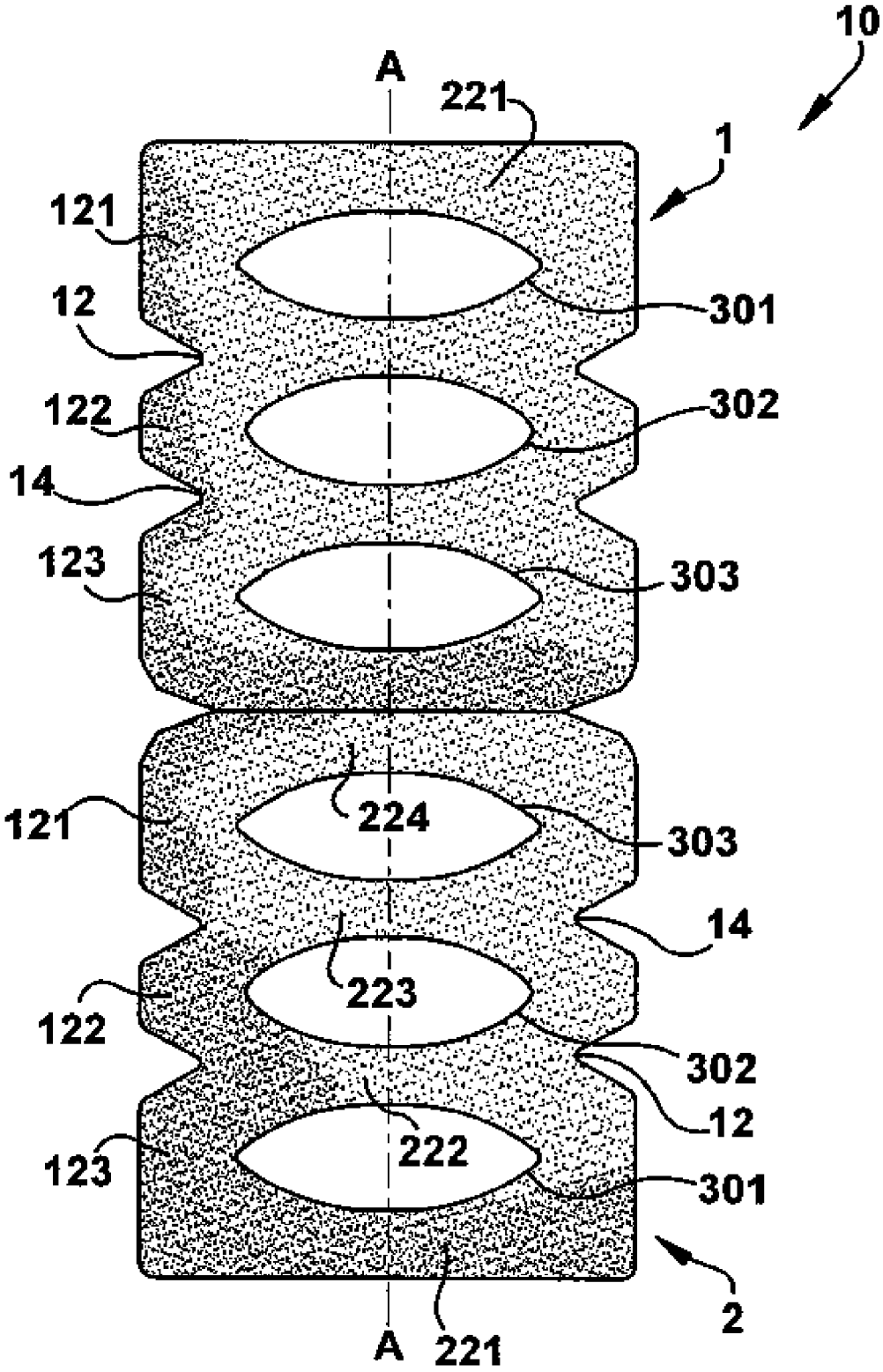
FIG. 1 is a representative embodiment of the foam spring.

FIG. 1 shows a representative embodiment of a particular embodiment of a foam spring 10 of the disclosure, consisting of individual and substantially identical foam spring components 1 and 2. Each foam spring component 1, 2 has interconnected first segments 121, 122, 123 which run generally in a first direction, and which may be oriented vertically or horizontally or otherwise when installed for use, and interconnected second segments 221, 222, 223, 224 which run generally in a second direction which is generally perpendicular to the first direction of first segments 121, 122, 123 and which may be oriented vertically or horizontally or otherwise when installed for use. For the sake of further description, the foam spring components 1, 2 and combination thereof will be described with reference to a vertical orientation wherein an axis A is oriented vertically wherein segment 221 of foam spring 1 or 2 serves as a base or foundation to the foam spring, and when foam spring components 1, 2 are symmetrically combined as shown in FIG. 1, the segment 221 of foam spring components 1 or 2 forms a generally planar exterior surface or top surface of the foam spring 10. The foam spring 10 has an axial length which extends between first and second generally planar spaced apart and parallel surfaces defined by the exterior surfaces of segments 221. However it is understood that the foam spring 10 can be positioned in other orientations with the axis A in a horizontal or other than vertical orientation. The foam spring components 1 and 2 can be secured together by adhesive or by welding, such as by thermal bonding, i.e., melting and co-joining of the facing surfaces of segments 224. Although illustrated with combined foam spring components 1 and 2, the foam spring 10 of the invention may comprise a single foam spring component which has multiple first segments and multiple interconnected second segments.

Under a load applied normal to segment 221, the segments 221, 222, and 223 transfer and distribute the load to segments 121, 122, 123 which will result in compression of the foam spring 10 along axis A as a result of the compressibility of the foam material, as will the segments 221, 222, 223, and 224, which may also deform and/or flex, for example, in the manner of beam flexure or sag centered approximately at axis A. Openings 301, 302, 303 in a central region of the foam spring components 1, 2 allow for flexure of the segments 221, 222, 223 and compression of the entire structure of the foam spring 10 upon compression of segments 121, 122, 123. The openings 301, 302, 303 are representative in form and number, and may be alternately configured in different cross-sectional profiles of the components 1, 2 in order to achieve different stiffness, compressibility and spring action and response (recoil or decompression) of the components 1, 2. To further enhance the compressive and spring action of the components 1, 2, grooves 12, 14 may be formed in the side walls of segments 121, 122, 123, and offset with respect to openings 301, 302, 303. The foam spring 10 thus has a structure and configuration of a spring, and which functions as a spring apart from and in addition to the material properties of the foam from which it is made, i.e., compressibility, resilience, memory, rigidity of the material and the cellular structure of the foam.

The foam from which the components 1, 2 are made is preferably polyurethane foam, or any other suitable type of foam or foamable material, which is extruded, molded, sculpted, shaped or otherwise formed in the described cross-sectional configuration, or equivalents thereof, by use of a die with the cross-sectional design. Extruded foam structures of this type can be formed with an outer skin and a plurality of contiguous cells, open or closed, within the outer skin which gives the foam structure/component inherent compressibility and decompression and memory to the original form defined by the outer skin. The outer skin is formed as a result of an extrusion process wherein the described cross-sectional configuration of the foam spring 10 is defined by an extrusion die. The outer skin acts as a shape-defining and containment structure which resists deformation of the form of the spring to a degree, and which has memory to return the spring to its original un-deformed configuration. As noted, other factors which determine the stiffness or compressibility of the foam spring 10 are the cross-sectional thicknesses of the described segments, the number and size of openings in the cross-section, the number, orientation and interconnection of the segments, i.e., layout of the cross-sectional design, and the number of foam spring components which are combined, such as for example, the symmetrical combination of components 1, 2 as shown in FIG. 1, and the type of material from which the foam spring 10 is made, the thickness of the outer skin, and the cellular structure of the foam.

Figure 2:
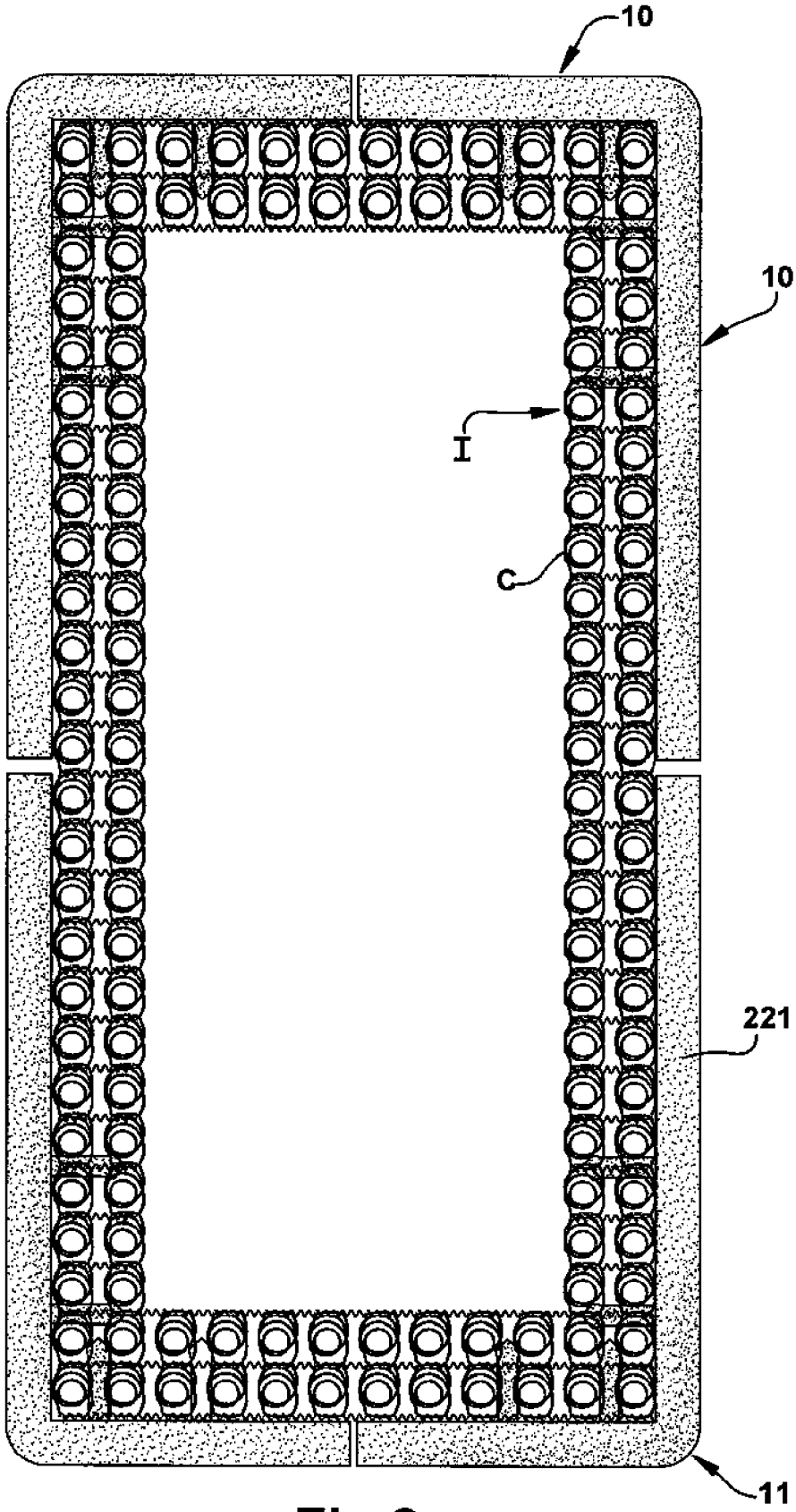
FIG. 2 is a representation of the foam spring positioned about a perimeter of an innerspring as combined internal components of a mattress or other innerspring system or core.
Figure 3:
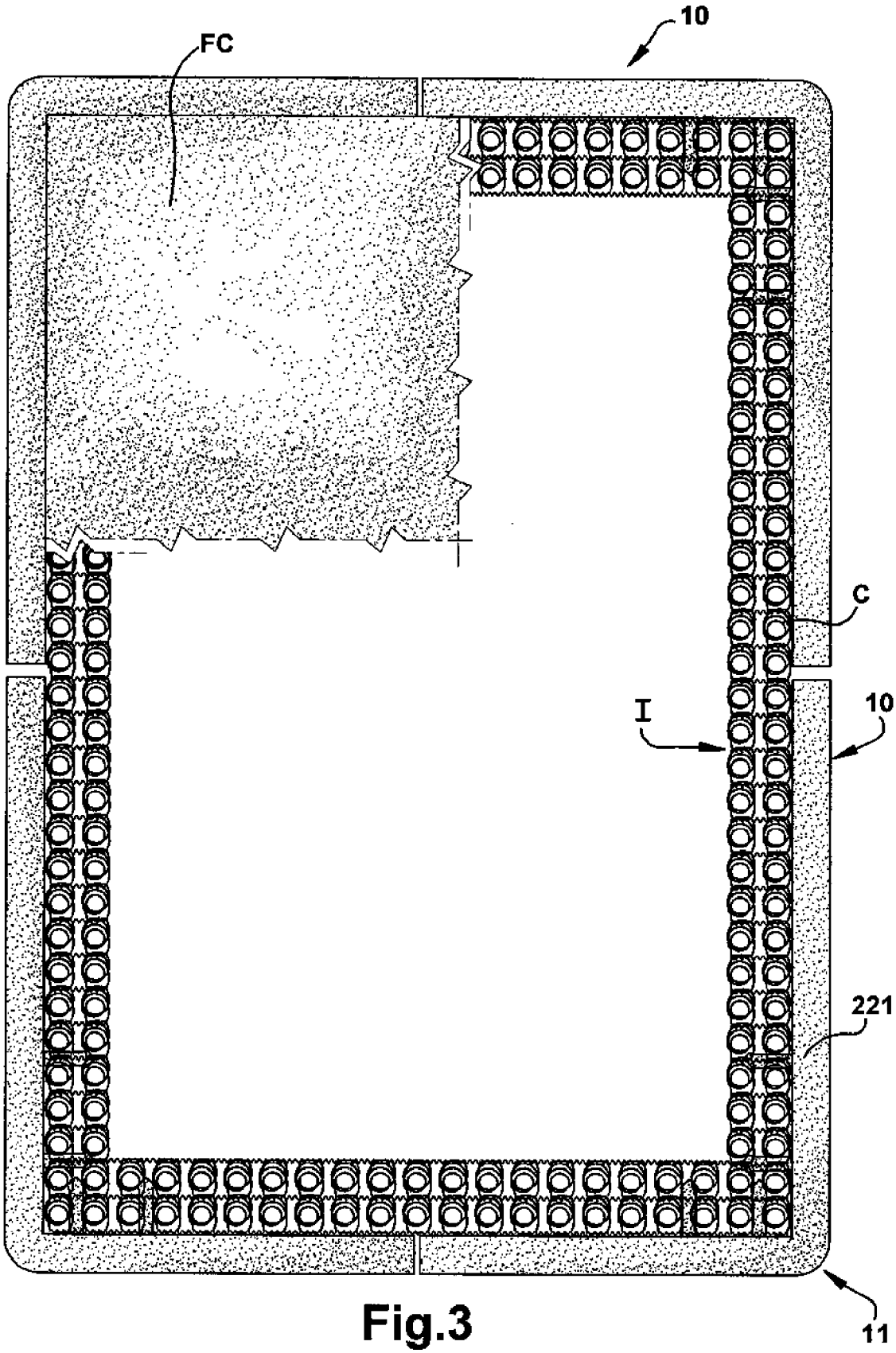
FIG. 3 is a representation of the foam spring positioned about the perimeter of a queen-sized innerspring as combined internal components of a mattress or other innerspring system or core.

As shown in FIGS. 2 and 3, the foam spring 10 is positioned about a perimeter of an innerspring I, represented by the interconnected rows and columns of coils C, which although not shown, may fill the entire area with additional rows and columns of coils C. As illustrated, there may be multiple pieces of foam spring 10 which are placed end-to-end or which may be spaced apart about the perimeter of the innerspring, and so arranged and combined with the innerspring I as combined internal components of a mattress or other innerspring system or core. Although described with reference to a mattress such as for sleeping, the combined internal components of the foam spring 10 and the innerspring I or any other type of core, such as foam or foam and spring combination, can be used in and for any support surface such as in seating and furniture, such as a foam core FC as shown. Other examples of mattress or padding cores which can be used in combination with the foam springs 10 (e.g., in place of a wire form innerspring) include, without limitation, a solid foam core of polyurethane type foam, latex foam, memory foam and foam cores made of combinations of different types, layers, inserts or section of foam material. When the foam springs 10 are used in combination with a foam core instead of a wire-form innerspring, this constitutes an alternate embodiment of a dual spring support structure as disclosed and claimed.

Figure 4:
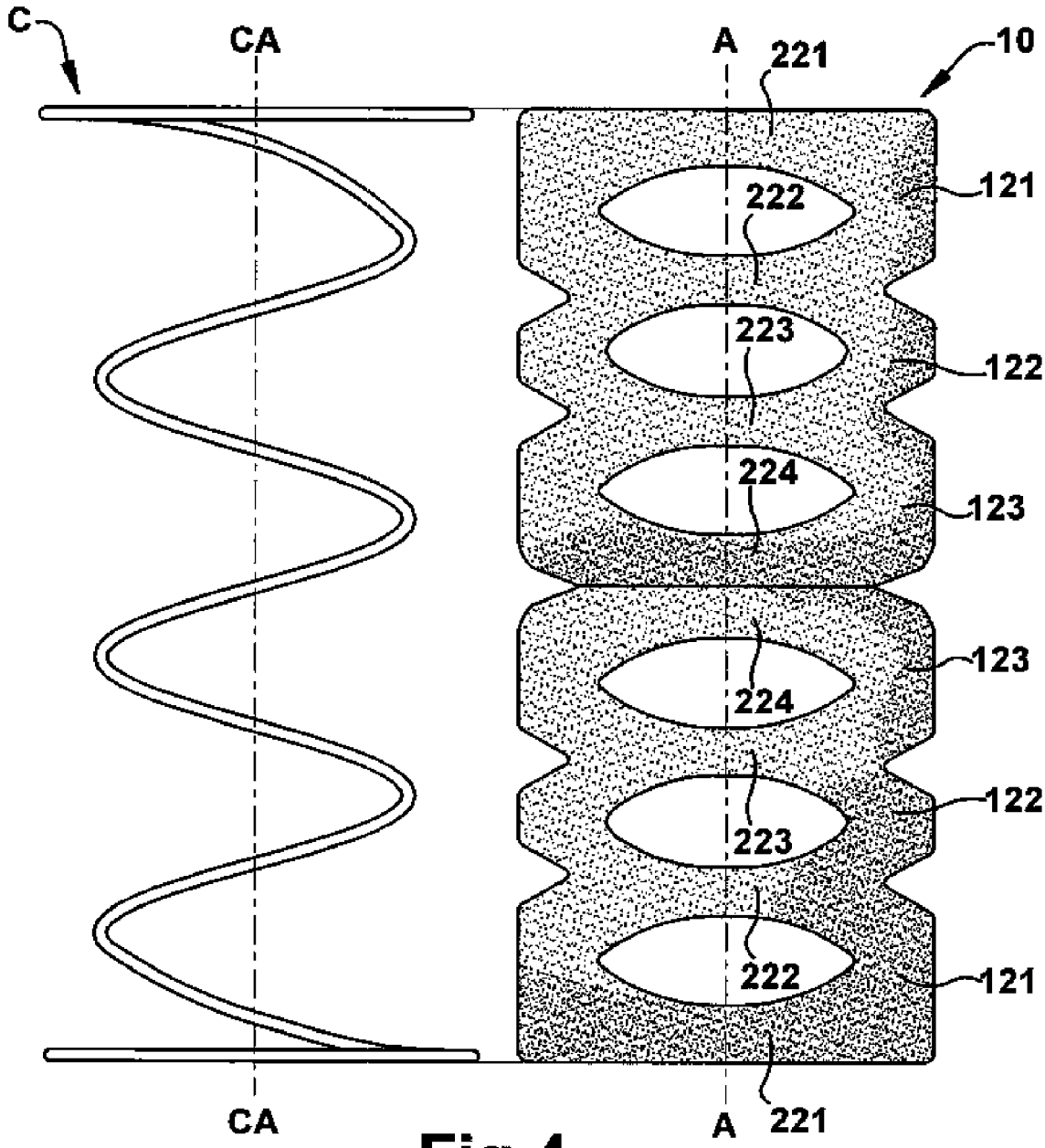
FIG. 4 is a representative foam spring positioned next to a coil of a type which can be used in an innerspring or other innerspring system or core.

With the coils oriented on-axis end as shown, the axis A of the foam spring 10 is aligned with the coil axes CA of the innerspring about the entire perimeter of the innerspring, as shown in FIG. 4, or alternatively along one or more sides of the innerspring, for example, along each of the longitudinal sides. As shown in FIG. 4, a linear or height dimension of the foam spring 10, as measured for example, from the outside edge of segment 221 or component 1 or the outside edge of segment 221 of component 2, is approximately equal to the common height of the coils C of the innerspring, as measured from coil end to coil end. The surface of segment 221 is therefore substantially aligned and flush with the support surface formed by the ends of the coils of the innerspring, i.e. with the support surface of the innerspring, so that the foam springs 10 contribute substantially to the support surface area of the combined foam spring and innerspring.

As shown in FIGS. 2 and 3, the surface area of the foam spring 10 is combined with the support area of the innerspring I to define the entire support surface or area of the mattress. Advantageously the foam spring 10 adds substantially to the total support area of the mattress and reduces the number of required individual springs or coils in the innerspring I, or otherwise reduces the required size of the mattress core.

Referring further to FIG. 4, with the axes of the coil C (coil axis CA) and foam spring 10 (A) generally vertically oriented and parallel, and the height or linear extent of the coil C being approximately equal to that of the foam spring 10, there is provided a dual spring structure in which the spring rate of the coil or coils C is either different from, comparable to, or complimentary with that of the foam spring 10. More particularly, each coil C of the innerspring has an axial extent or height which is approximately equal to an axial length of the foam spring 10 as measured from the first generally planar exterior surface of segment 221 of foam spring component 1 to the second generally planar exterior surface of segment 221 of foam spring component 2. In one embodiment of the disclosure and invention, the spring rate of the coils C or that of the innerspring I is substantially the same as a spring rate of the foam spring 10. In another embodiment the spring rate of the coils C or that of the innerspring I is greater than that of the foam spring 10. And in another embodiment the spring rate of the coils C, particularly coils located at the perimeter, or that of the innerspring I is less a that of the foam spring 10.

Figure 5:
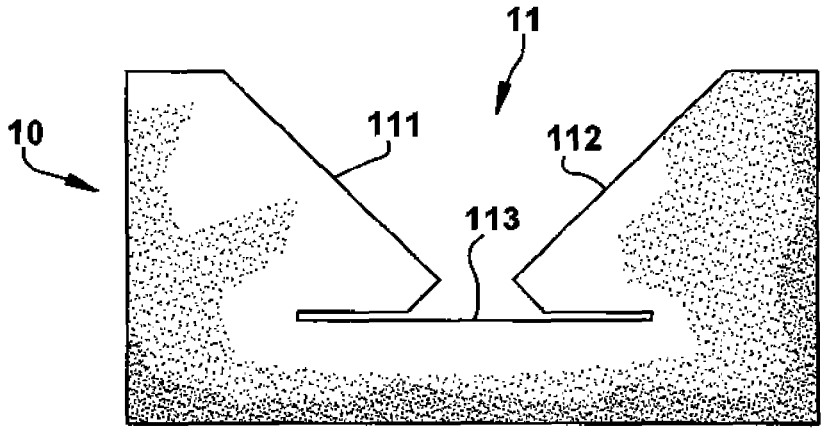
FIG. 5 is a representation of an internally mitered corner with angled facing and interior relief cuts.
Figure 6:
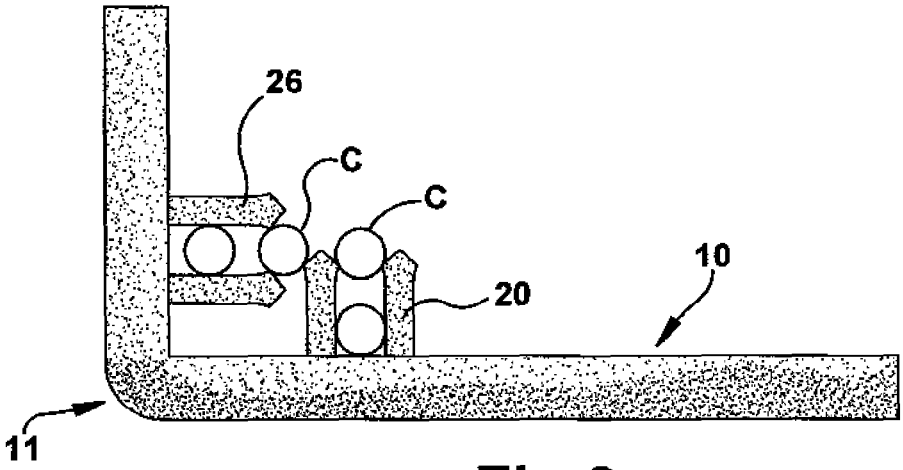
FIG. 6 is a representation of the locking keys secured to an interior wall of the foam spring and positioned between the coils of the innerspring.
Figure 7:
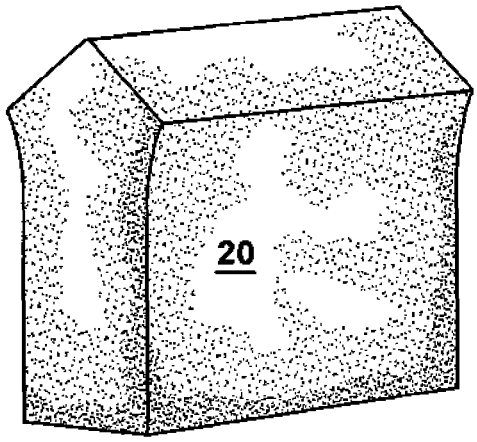
FIG. 7 is a representation of a locking key.

As shown in FIG. 5, the foam spring 10 may further include internally mitered corners 11 with angled facing cuts 111, 112 and interior relief cut 113, so that the outer wall defined by segments 121, 122, 123 runs continuous around the corner 11 without a through cut entirely through a cross-section of the foam spring 10. This provides a smooth continuous exterior wall to the foam spring 10 which is advantageous for application of padding and upholstery. As shown in FIGS. 6 and 7, locking keys 20 can be secured to an interior wall of the foam spring 10 for insertion between the perimetrical coils C of the innerspring I in order to mechanically engage the foam spring 10 with the innerspring. The locking keys 20 can be constructed of solid foam as shown with tapered ends which fit with the circular shape of the coils C. The coils C shown in FIG. 6 are optional, and may be absent in the case where the core of a mattress is made entirely of foam, of the types or combinations of foam types mentioned. Locking keys 20 can optionally be used to interconnect the foam spring 10 with a foam core. Alternatively, adhesive can be employed to secure the foam spring 10 to a perimeter edge of a foam core. The locking keys 20 may be made with the same or different spring rate or density as the foam spring 10.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A foam spring comprising at least two individual and substantially identical foam spring components that are symmetrically combined, each foam spring component comprising:

two first segments which are spaced apart in horizontal alignment and generally parallel and vertically oriented;

at least three second segments, each of the at least three second segments extending between the two first segments and being generally parallel and generally horizontally oriented and generally perpendicular to the first segments;

the spaced apart second segments forming one or more openings in each of the two foam spring components;

at least one groove formed in an exterior side wall of each of the two first segments, each groove running horizontally along a length of the foam spring components and offset horizontally with respect to the openings in the foam spring components.

2. The foam spring of claim 1 wherein the foam spring components are made of extruded polyurethane closed cell foam.

3. The foam spring of claim 1 wherein each of the first segments are generally vertically oriented and the second segments are generally horizontally oriented.

4. The foam spring of claim 1 wherein the foam spring further comprises internally mitered corners with two angle facing cuts and one interior relief cut.

5. A dual spring support structure comprising:

an innerspring having a plurality of individual wire form coils interconnected in a rectangular matrix;

a foam spring comprising at least two individual and substantially identical foam spring components that are symmetrically combined, each foam spring component comprising:

at least two interconnected and horizontally aligned first segments running in a first direction;

at least three interconnected second segments running in a second direction and generally perpendicular to the first direction of the first segments;

one or more openings in the central region of the foam spring components; at least one groove formed in the side walls of the at least two interconnected first segments running horizontally in a first direction and offset horizontally with respect to the one or more openings in the central region of the foam spring components, wherein one or more pieces of foam spring is positioned proximate to or about the perimeter of the innerspring;

wherein the surface of the foam spring is contiguous with a support surface or plane of the innerspring and is compressible with the innerspring;

wherein the height of the foam spring is approximately equal to the height of the plurality of wire form coils.

6. The innerspring of claim 5 wherein the spring rate of the foam spring is approximately equal to the spring rate of the plurality of wire form coils.

7. The innerspring of claim 5 wherein the spring rate of the foam spring is greater than the spring rate of the plurality of wire form coils.

8. The innerspring of claim 5 wherein the spring rate of the foam spring is less than the spring rate of the plurality of wire form coils.

9. The innerspring of claim 5 wherein locking keys are secured to an interior wall of the foam spring for insertion between the plurality of wire form coils.

10. The innerspring of claim 5 wherein the foam spring components are made from polyurethane foam.

11. The innerspring of claim 5 wherein the foam springs further include internally mitered corners with two angle facing cuts and one interior relief cut.

12. A mattress comprised of:

an innerspring comprised of:

a plurality of individual wire form coils interconnected in a rectangular matrix;

a foam spring comprising:

at least two individual and substantially identical foam spring components that are symmetrically combined, each foam spring component comprising:

at least two interconnected and horizontally aligned first segments running in a first direction;

at least three interconnected second segments running in a second direction and generally perpendicular to the first direction of the first segments;

one or more openings in the central region of the foam spring components;

at least one groove formed in the side walls of the at least two interconnected first segments running horizontally in a first direction and offset horizontally with respect to the one or more openings in the central region of the foam spring components, padding; and upholstery, wherein one or more pieces of foam spring is positioned proximate to or about the perimeter of the innerspring;

wherein the surface of the foam spring is contiguous with a support surface or plane of the innerspring and is compressible with the innerspring;

wherein the height of the foam spring is approximately equal to the height of the plurality of wire form coils.

13. The mattress of claim 12 wherein the foam spring components are made from polyurethane foam.

14. The mattress of claim 12 wherein the foam spring components further include internally mitered corners with two angle facing cuts and one interior relief cut.

15. The mattress of claim 12 wherein the spring rate of the foam spring is approximately equal to the spring rate of the plurality of wire form coils.

16. The mattress claim 12 wherein the spring rate of the foam spring is greater than the spring rate of the plurality of wire form coils.

17. The mattress of claim 12 wherein the spring rate of the foam spring is less than the spring rate of the plurality of wire form coils.

18. The mattress of claim 12 wherein locking keys are secured to an interior wall of the foam spring for insertion between the plurality of wire form coils.

19. A dual spring support structure comprising:

a generally elongate foam spring having a cross-sectional configuration with at least two parallel, horizontally aligned and spaced apart first segments, and at least two parallel and spaced apart second segments which extend between the first segments, and at least two openings located between the first segments and the second segments, one of the first segments having a first generally planar exterior surface and another of the first segments having a second generally planar exterior surface which is spaced from and parallel to the first generally planar exterior surface, at least one groove formed in an exterior surface of each of the at least two first segments, each groove running horizontally along a length of the at least two first segments and offset horizontally with respect to the at least two openings the foam spring being compressible between the first and second generally planar exterior surfaces, the foam spring having an axial length which extends from the first generally planar exterior surface to the second generally planar exterior surface;

the foam spring positioned proximate to a perimeter of an innerspring having a plurality of wire coils which are axially aligned, each coil having a first end and a second end, a first end of each coil of the innerspring located generally co-planar with the first generally planar exterior surface of the foam spring, and a second end of each coil located generally co-planar with the second generally planar exterior of the foam spring.

* * * * *